US011569032B2

(12) United States Patent
Takahashi

(10) Patent No.: US 11,569,032 B2
(45) Date of Patent: Jan. 31, 2023

(54) COIL COMPONENT

(71) Applicant: Murata Manufacturing Co., Ltd., Kyoto-fu (JP)

(72) Inventor: Katsuyuki Takahashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 639 days.

(21) Appl. No.: 16/663,125

(22) Filed: Oct. 24, 2019

(65) Prior Publication Data

US 2020/0203070 A1 Jun. 25, 2020

(30) Foreign Application Priority Data

Dec. 24, 2018 (JP) ..... JP2018-240437

(51) Int. Cl.
*H01F 17/04* (2006.01)
*H01F 27/28* (2006.01)
(Continued)

(52) U.S. Cl.
CPC ..... *H01F 41/06* (2013.01); *H01F 17/045* (2013.01); *H01F 27/2823* (2013.01); *H01F 27/292* (2013.01); *H01F 41/0246* (2013.01)

(58) Field of Classification Search
CPC .... H01F 41/06; H01F 17/045; H01F 27/2823; H01F 27/292; H01F 41/0246
See application file for complete search history.

(56) References Cited

U.S. PATENT DOCUMENTS 6,373,366 B1 * 4/2002 Sato ..... H01F 27/292 336/200
2008/0224813 A1 * 9/2008 Hirai ..... H01F 17/045 336/216
(Continued)

FOREIGN PATENT DOCUMENTS

JP 2009-147159 A 7/2009
JP 2014-099587 A 5/2014
(Continued)

OTHER PUBLICATIONS

An Office Action; "Notice of Reasons for Refusal," mailed by the Japanese Patent Office dated May 11, 2021, which corresponds to Japanese Patent Application No. 2018-240437 and is related to U.S. Appl. No. 16/663,125 with English language translation.

*Primary Examiner* — Elvin G Enad
*Assistant Examiner* — Malcolm Barnes
(74) *Attorney, Agent, or Firm* — Studebaker & Brackett PC

(57) ABSTRACT

A coil component includes a winding core that includes a winding core portion, a first flange portion, and a second flange portion. The coil component further includes a plate core that has a main surface facing the winding core portion, the first flange portion, and the second flange portion, that extends between the first flange portion and the second flange portion, and that is secured to the winding core by using adhesive. Each of the first flange portion and the second flange portion has an upper surface that faces the main surface of the plate core. Recessed portions are formed on the corresponding upper surfaces. Protrusions may be formed in corresponding regions in which the recessed portions are formed.

20 Claims, 4 Drawing Sheets

(51) Int. Cl.

| | |
|---|---|
| ***H01F 27/29*** | (2006.01) |
| ***H01F 41/06*** | (2016.01) |
| ***H01F 41/02*** | (2006.01) |

(56) References Cited

U.S. PATENT DOCUMENTS

| | | | | |
|---|---|---|---|---|
| 2015/0042436 | A1* | 2/2015 | Arimitsu | H01F 17/045 336/192 |
| 2015/0162126 | A1* | 6/2015 | Kanbe | H01F 27/2823 29/605 |
| 2017/0053726 | A1* | 2/2017 | Takagi | H05K 1/165 |
| 2017/0288626 | A1* | 10/2017 | Kobayashi | H01F 27/006 |
| 2018/0286554 | A1* | 10/2018 | Kojima | H01F 27/29 |
| 2019/0318866 | A1* | 10/2019 | Mikogami | H01F 27/2828 |
| 2020/0105451 | A1* | 4/2020 | Horie | H01F 17/045 |

FOREIGN PATENT DOCUMENTS

| | | | |
|---|---|---|---|
| JP | 2015-35473 | A | 2/2015 |
| JP | 2018-174219 | A | 11/2018 |
| JP | 2019-186415 | A | 10/2019 |

* cited by examiner

COIL COMPONENT

CROSS-REFERENCE TO RELATED APPLICATION

This application claims benefit of priority to Japanese Patent Application No. 2018-240437, filed Dec. 24, 2018, the entire content of which is incorporated herein by reference.

BACKGROUND

Technical Field

The present disclosure relates to a coil component, and more particularly to a coil component that includes a winding core including a winding core portion around which a wire is wound, and a first flange portion and a second flange portion that are disposed on corresponding end portions of the winding core portion and that are opposite each other, and that includes a plate core that extends between the first flange portion and the second flange portion.

Background Art

An interesting technique for the present disclosure is disclosed in, for example, Japanese Unexamined Patent Application Publication No. 2014-99587. FIG. 6 is drawn on the basis of FIG. 2(a) in Japanese Unexamined Patent Application Publication No. 2014-99587 and illustrates a first flange portion 3 and a plate core 4 of a winding core 2 of a coil component 1.

The winding core 2 includes a winding core portion around which a wire is wound, and the first flange portion and a second flange portion that are disposed on corresponding end portions of the winding core portion. In FIG. 6, of the first flange portion and the second flange portion, the first flange portion 3 is illustrated, and the winding core portion and the second flange portion are concealed by the first flange portion 3 and are not illustrated. The plate core 4 has a main surface 5 that faces the winding core portion, the first flange portion 3, and the second flange portion, not illustrated, of the winding core 2, extends between the first flange portion 3 and the second flange portion, and is secured to the winding core 2 by using adhesive 6. The first flange portion 3 has an upper surface 7 that faces the main surface 5 of the plate core 4. Similarly, the second flange portion has an upper surface.

A structure disclosed in Japanese Unexamined Patent Application Publication No. 2014-99587 enables a high adhesive strength between the winding core 2 and the plate core 4 to be achieved although the amount of the adhesive 6 is small. The first flange portion 3 illustrated will be more specifically described. A central portion 9 of the upper surface 7 of the first flange portion 3 has a flat surface 8 at the highest position. Inclined surfaces 10 and 11 are formed such that the position thereof is gradually lowered from the flat surface 8 toward the end portions. The flat surface 8 and the inclined surfaces 10 and 11 are on planes.

Consequently, the upper surface 7 of the first flange portion 3 and the main surface 5 of the plate core 4 are in direct contact with each other along the flat surface 8 of the central portion 9 of the upper surface 7 without the adhesive 6 interposing therebetween. Gaps that gradually become narrow from the end portions of the upper surface 7 toward the central portion of the upper surface 7 are interposed between the upper surface 7 and the main surface 5. The adhesive 6 is located in the gaps.

The technique disclosed in Japanese Unexamined Patent Application Publication No. 2014-99587 enables a capillary phenomenon to occur in the gaps near the flat surface 8 of the central portion of the upper surface 7 and enables space between the first flange portion 3 and the plate core 4 to be filled with the adhesive 6 in the minimum amount. It is disclosed that a relatively high adhesive strength between the winding core 2 and the plate core 4 can be accordingly achieved by using the adhesive 6 in a relatively small amount.

SUMMARY

In the technique disclosed in Japanese Unexamined Patent Application Publication No. 2014-99587, attention is paid to the adhesive strength between the winding core 2 and the plate core 4. However, the mechanical strength of the winding core 2 itself is not particularly considered.

Typically, the winding core 2 and the plate core 4 are each composed of a sintered body that is obtained by firing a pressed and molded body of magnetic material powder. The present inventor has found that the circumferential length of the wire that is wound around the winding core portion is preferably decreased to increase the number of turns of the wire in order to improve electrical characteristics of the coil component 1 even if an inner, magnetic path of a coil is sacrificed. For this reason, it can be considered that the winding core portion is narrowed.

However, when each of the winding core 2 and the plate core 4 is composed of the sintered body of the magnetic material powder as above, a problem in that the mechanical strength of the winding core 2 decreases becomes more serious as the size of the coil component 1 decreases. It has been found that the winding core portion that is thinned is likely to break due to the decrease in the mechanical strength. It has also been found that breakage is likely to occur particularly at joints between the winding core portion and the flange portions.

Accordingly, the present disclosure provides a coil component that includes a winding core that has a sufficient mechanical strength.

According to preferred embodiments of the present disclosure, a coil component includes a winding core that includes a winding core portion, and a first flange portion and a second flange portion that are disposed on corresponding end portions of the winding core portion and that are opposite each other in an axial direction. The coil component further includes a plate core that has a main surface facing the winding core portion, the first flange portion, and the second flange portion, that extends between the first flange portion and the second flange portion, and that is secured to the winding core by using adhesive, and at least one wire that is wound around the winding core portion.

Each of the first flange portion and the second flange portion has an upper surface that faces the main surface of the plate core. A recessed portion is formed on the upper surface of the first flange portion or the upper surface of the second flange portion, or recessed portions are formed on the corresponding upper surfaces, and the recessed portion or each of the recessed portions has a bottom that is located such that the bottom approaches a position of the winding core portion in a central portion in a direction perpendicular to the axial direction of the winding core portion.

According to preferred embodiments of the present disclosure, since the recessed portion is formed on the upper surface of the first flange portion or the upper surface of the second flange portion, or the recessed portions are formed on the corresponding upper surfaces, the mechanical strength of the winding core, particularly, the mechanical strength of joints between the winding core portion and the flange portions is improved. Accordingly, a sufficient mechanical strength of the winding core is ensured, and the size of the coil component or the diameter of the winding core portion can be advantageously decreased.

Other features, elements, characteristics and advantages of the present disclosure will become more apparent from the following detailed description of preferred embodiments of the present disclosure with reference to the attached drawings.

DETAILED DESCRIPTION

Figure 1:
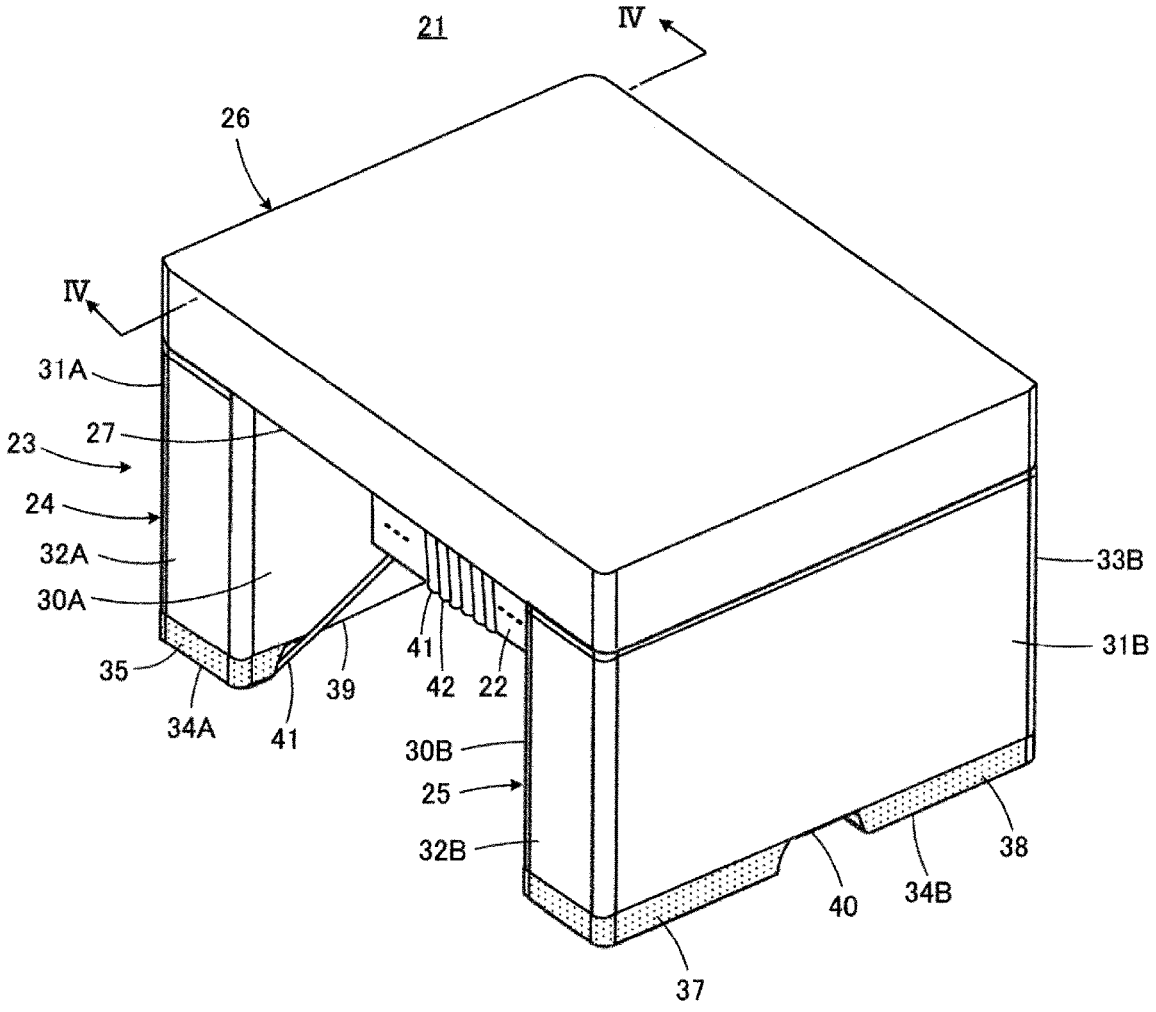
FIG. 1 is a perspective view of the appearance of a coil component according to a first embodiment of the present disclosure.

A coil component 21 according to a first embodiment of the present disclosure will be described with reference to FIG. 1 to FIG. 4. The coil component 21 illustrated forms a common mode choke coil.

The coil component 21 includes a winding core 23 that includes a winding core portion 22. The winding core 23 includes a first flange portion 24 and a second flange portion 25 that are disposed on corresponding end portions of the winding core portion 22 and that are opposite each other in the axial direction.

The coil component 21 also includes a plate core 26. The plate core 26 has a main surface 27 that faces the winding core portion 22, the first flange portion 24, and the second flange portion 25 of the winding core 23, extends between the first flange portion 24 and the second flange portion 25, and is secured to the winding core 23 by using adhesive 28 (see FIG. 4). For example, the adhesive 28 is applied between the plate core 26 and the first flange portion 24 and between the plate core 26 and the second flange portion 25. An example of the adhesive 28 is a thermosetting epoxy resin. The plate core 26 and the winding core 23 are secured to each other by performing hot pressing at about 150° C. for about 10 minutes.

The first flange portion 24 has an upper surface 29A that faces the main surface 27 of the plate core 26. The second flange portion 25 has an upper surface 29B that faces the main surface 27 of the plate core 26. The first flange portion 24 has an inner surface 30A that faces the winding core portion 22 and that is in contact with one end portion of the winding core portion 22 and an outer surface 31A that faces the outside and that is opposite the inner surface 30A. The second flange portion 25 has an inner surface 30B that faces the winding core portion 22 and that is in contact with the other end portion of the winding core portion 22 and an outer surface 31B that faces the outside and that is opposite the inner surface 30B. The first flange portion 24 also has a first side surface 32A and a second side surface 33A that connect the inner surface 30A and the outer surface 31A to each other and that are opposite each other. The second flange portion 25 also has a first side surface 32B and a second side surface 33B that connect the inner surface 30B and the outer surface 31B to each other and that are opposite each other. The first flange portion 24 also has a bottom surface 34A that is opposite the upper surface 29A. The second flange portion 25 also has a bottom surface 34B that is opposite the upper surface 29B. The upper surface 29A and the bottom surface 34A connect the inner surface 30A and the outer surface 31A to each other and connect the first side surface 32A and the second side surface 33A to each other. Similarly, the upper surface 29B and the bottom surface 34B connect the inner surface 30B and the outer surface 31B to each other and connect the first side surface 32B and the second side surface 33B to each other. The bottom surfaces 34A and 34B are to face a mounting substrate when the coil component 21 is mounted.

According to the embodiment illustrated, the inner surfaces 30A and 30B are parallel to the outer surfaces 31A and 31B. The inner surfaces 30A and 30B, however, may not be parallel to the outer surfaces 31A and 31B.

For example, the winding core portion 22 has a substantially quadrangular prism shape having a rectangular sectional shape or a substantially rectangular sectional shape. However, the winding core portion 22 is not limited thereto and may have a substantially triangular prism shape, a substantially pentagonal prism shape, a substantially hexagonal prism shape, another polygonal prism shape, or a substantially cylindrical shape.

Examples of dimensions of the winding core 23 are as follows. The distance between the outer surface 31A of the first flange portion 24 and the outer surface 31B of the second flange portion 25 is about 3.2 mm. The distance between the first side surface 32A and the second side surface 33A of the first flange portion 24 and the distance between the first side surface 32B and the second side surface 33B of the second flange portion 25 are about 2.5 mm. The dimensions of a section of the winding core portion 22 are about 0.7 mm in length and about 1.0 mm in width. The main surface 27 of the plate core 26 has a dimension of about 3.2 mm× about 2.5 mm, which depends on a dimension of about 3.2 mm× about 2.5 mm that the winding core 23 has. The thickness of the plate core 26 is about 0.7 mm.

As illustrated in FIG. 1, a first terminal electrode 35 and a second terminal electrode 36 are disposed on the bottom surface 34A of the first flange portion 24 and the vicinity thereof. In FIG. 1, the second terminal electrode 36 is concealed by the plate core 26 and the winding core portion 22 and are not illustrated but is designated by the reference number "36" for convenience of the description. A third terminal electrode 37 and a fourth terminal electrode 38 are disposed on the bottom surface 34B of the second flange portion 25 and the vicinity thereof. The first terminal electrode 35 and the second terminal electrode 36 are isolated from each other with a notch 39 that is formed on the bottom surface 34A of the first flange portion 24 interposed therebetween. The third terminal electrode 37 and the fourth terminal electrode 38 are isolated from each other with a notch 40 that is formed on the bottom surface 34B of the second flange portion 25 interposed therebetween.

The first to fourth terminal electrodes 35 to 38 are formed, for example, by applying and baking conductive paste a conductive component of which is silver or by spattering nickel-chrome and nickel-copper. A plating film may be formed as needed. The plating film is composed of, for example, a Cu plating layer, a Ni plating layer on the Cu plating layer, and a Sn plating layer on the Ni plating layer.

As illustrated in FIG. 1, the first and second terminal electrodes 35 and 36 are formed so as to extend from the bottom surface 34A of the first flange portion 24 to parts of the outer surface 31A, the inner surface 30A, and the first side surface 32A or the second side surface 33A, and the third and fourth terminal electrodes 37 and 38 are formed so as to extend from the bottom surface 34B of the second flange portion 25 to parts of the outer surface 31B, the inner surface 30B, and the first side surface 32B, or the second side surface 33B. However, the first to fourth terminal electrodes 35 to 38 may be formed only on the bottom surfaces 34A and 34B or may be formed only on the outer surfaces 31A and 31B or may be formed so as to extend to the plate core 26. The first to fourth terminal electrodes 35 to 38 may be disposed by mounting terminal metal fittings composed of conductive metal on the first flange portion 24 and the second flange portion 25.

As schematically illustrated in FIG. 1, for example, a first wire 41 and a second wire 42 are spirally wound around the winding core portion 22 in the same direction. The first wire 41 and the second wire 42 are each composed of, for example, a copper wire that is coated with an electrically insulating resin such as polyurethane, imide-modified polyurethane, polyester imide, or polyamide imide and that has a diameter of no less than 0.020 mm and no more than 0.080 mm (i.e., from 0.020 mm to 0.080 mm). The first wire 41 and the second wire 42 may be wound so as to form layers as needed. FIG. 1 illustrates a state in which a first end of the first wire 41 is connected to the first terminal electrode 35. Similarly, a second end of the first wire 41 opposite the first end is connected to the third terminal electrode 37, a first end of the second wire 42 is connected to the second terminal electrode 36, and a second end of the second wire 42 opposite the first end is connected to the fourth terminal electrode 38, although these are not illustrated. The first wire 41 and the second wire 42 are connected to the first to fourth terminal electrodes 35 to 38 by, for example, thermo-compression bonding.

The winding core 23 and the plate core 26 contain magnetic material powder such as NiZn ferrite powder and form a closed magnetic circuit in cooperation with each other. Typically, the winding core 23 and the plate core 26 are each composed of a sintered body that is manufactured by firing a molded body that is obtained by pressing and molding magnetic material powder. The winding core 23 and the plate core 26 are not limited to the sintered body of the magnetic material powder and may be each composed of, for example, cured resin that contains the magnetic material powder or a compressed and molded body of the magnetic material powder (non-sintered body).

A characteristic structure of the coil component 21 will now be described.

Figure 2:
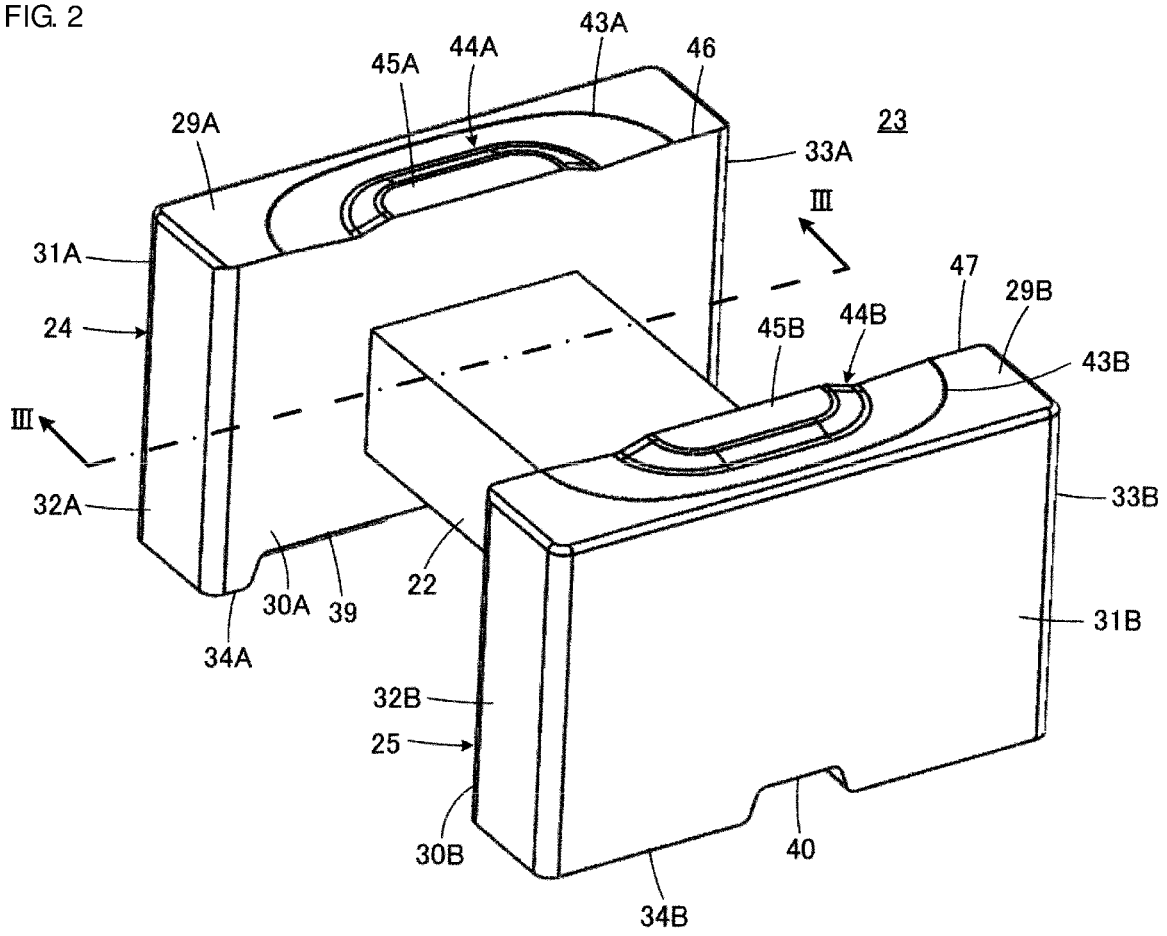
FIG. 2 is a perspective view of a winding core that the coil component illustrated in FIG. 1 includes.
Figure 3:
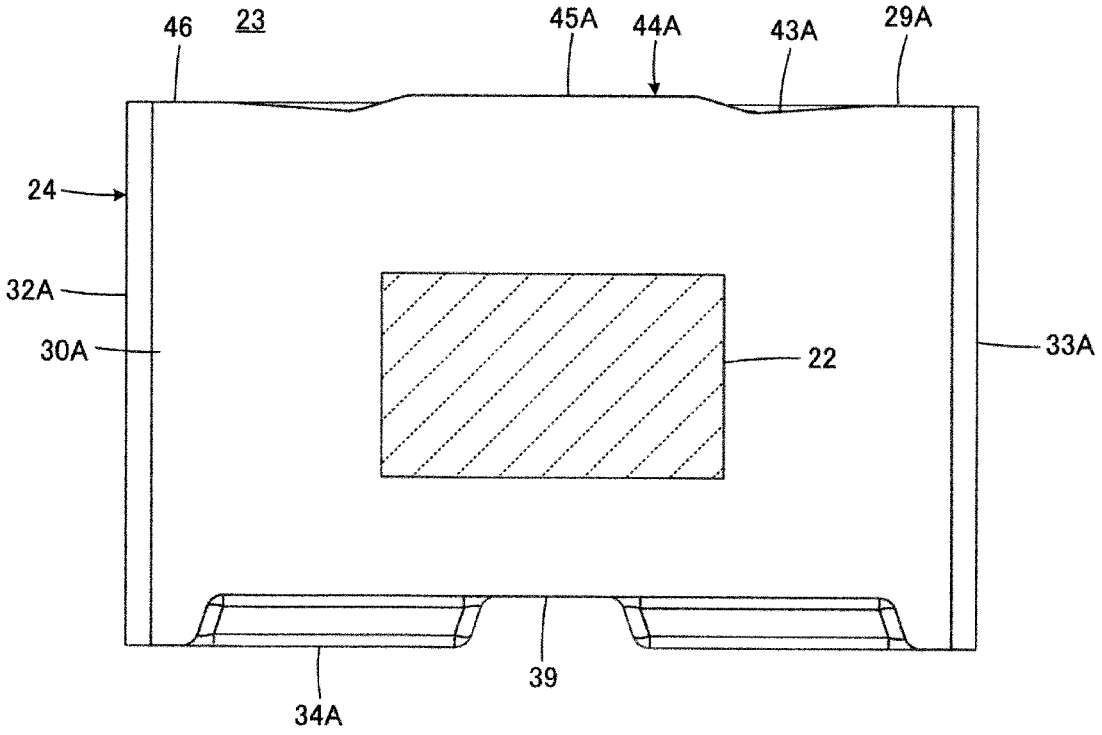
FIG. 3 is a sectional view of the winding core illustrated in FIG. 2 taken along line III-III in FIG. 2.

Attention is paid to the upper surface 29A of the first flange portion 24 and the upper surface 29B of the second flange portion 25. As well illustrated in FIG. 2 to FIG. 4, a recessed portion 43A and a recessed portion 43B are formed thereon. The recessed portion 43A has a bottom that is located such that the bottom approaches the position of the winding core portion 22 in a central portion of the upper surface 29A in the direction perpendicular to the axial direction of the winding core portion 22. The recessed portion 43B has a bottom that is located such that the bottom approaches the position of the winding core portion 22 in a central portion of the upper surface 29B in the direction perpendicular to the axial direction of the winding core portion 22. In FIG. 2 and FIG. 3, uneven shapes and curved shapes such as the recessed portion 43A and the recessed portion 43B are emphasized by adding auxiliary lines such as contour lines. It has been revealed that the mechanical strength of the winding core 23, particularly, the mechanical strength of joints between the winding core portion 22 and the first flange portion 24 and between the winding core portion 22 and the second flange portion 25 can be increased by the recessed portion 43A and the recessed portion 43B that are thus formed on the upper surface 29A and the upper surface 29B, although the reason is unclear.

Accordingly, the above characteristic structure is advantageously used for the coil component 21 in the case where the winding core portion 22 of the coil component 21 is thin, more specifically, in the case where, regarding sectional areas along a plane perpendicular to the axis of the winding core portion 22, the ratio of a sectional area of the winding core portion 22 to each sectional area of the of the first flange portion 24 and the second flange portion 25 is no less than 0.14 and no more than 0.25 (i.e., from 0.14 to 0.25).

The depths of the recessed portion 43A and the recessed portion 43B of the winding core 23 that has the dimension described above by way of example are about 10 μm.

The recessed portion 43A is preferably formed on a portion of the upper surface 29A and is located in the central portion of the upper surface 29A in the direction perpendicular to the axial direction of the winding core portion 22. The recessed portion 43B is preferably formed on a portion of the upper surface 29B and is located in the central portion of the upper surface 29B in the direction perpendicular to the axial direction of the winding core portion 22. The recessed portion 43A may be formed on the entire upper surface 29A. The recessed portion 43B may be formed on the entire upper surface 29B. However, forming the upper surface 29A and the upper surface 29B on the parts as above ensures a sufficient area of direct contact between the upper surface 29A and the main surface 27 of the plate core 26 and between the upper surface 29B and the main surface 27 of the plate core 26 or a sufficient area of connection thereof with the adhesive 28 interposed therebetween. The strength can be effectively improved in the case where the recessed portion 43A and the recessed portion 43B are located in the central portions of the upper surface 29A and the upper surface 29B in the direction perpendicular to the axial direction of the winding core portion 22. This leads to an improvement in inductance value. In the specification, the central portion in the direction perpendicular to the axial direction of the winding core portion means a portion on the upper surface 29A or the upper surface 29B in an extension region of the winding core portion 22.

Figure 4:
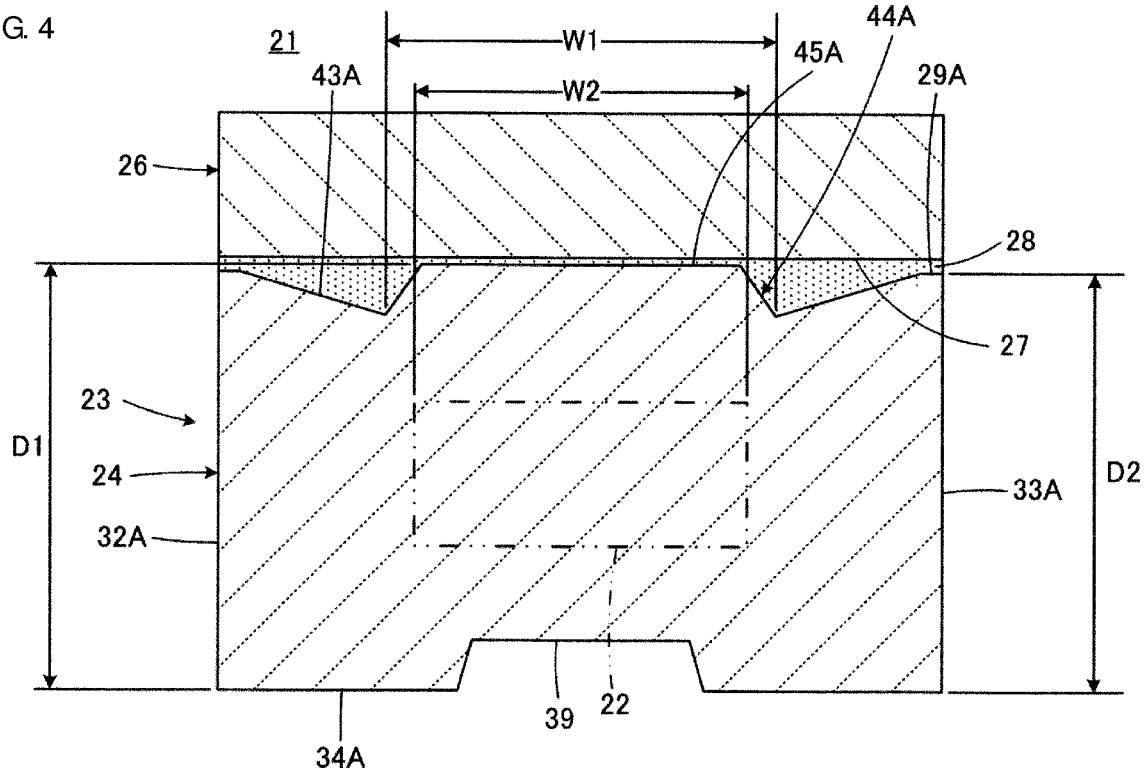
FIG. 4 is a sectional view of a combination of the winding core and a plate core that the coil component illustrated in FIG. 1 includes, taken along line IV-IV in FIG. 1.

As the recessed portion 43A is illustrated in FIG. 4, the shapes of the recessed portion 43A and the recessed portion 43B may be defined by an inner surface that is substantially linear in section or may be defined by an inner surface that is curved in section. The shapes of the recessed portion 43A and the recessed portion 43B may also be defined by an inner surface that is substantially rectangular in section or may be defined by an inner surface that is substantially trapezoidal in section.

According to the present embodiment, a protrusion 44A is formed in the region in which the recessed portion 43A is formed on the upper surface 29A, and a protrusion 44B is formed in the region in which the recessed portion 43B is formed on the upper surface 29B. As a result of the recessed portion 43A and the recessed portion 43B being formed, air gaps are formed between the upper surface 29A and the plate core 26 and between the upper surface 29B and the plate core 26, where a magnetic path runs between the upper surfaces. Consequently, the inductance value decreases because a magnetic path particularly for a radio frequency signal is generated such that the length thereof becomes the minimum, and variation in the inductance value tends to increase due to variation in the depth and/or the width of each air gap. However, in the case where the protrusion 44A and the protrusion 44B are formed inside the recessed portion 43A and the recessed portion 43B, a closed magnetic circuit can be formed along an inner path of loop paths for magnetic flux, and the inductance value at a radio frequency can be increased. That is, according to the present embodiment, the mechanical strength can be improved, and the electrical characteristics can be improved.

The present embodiment also has the following features to improve the electrical characteristics.

Figure 5:
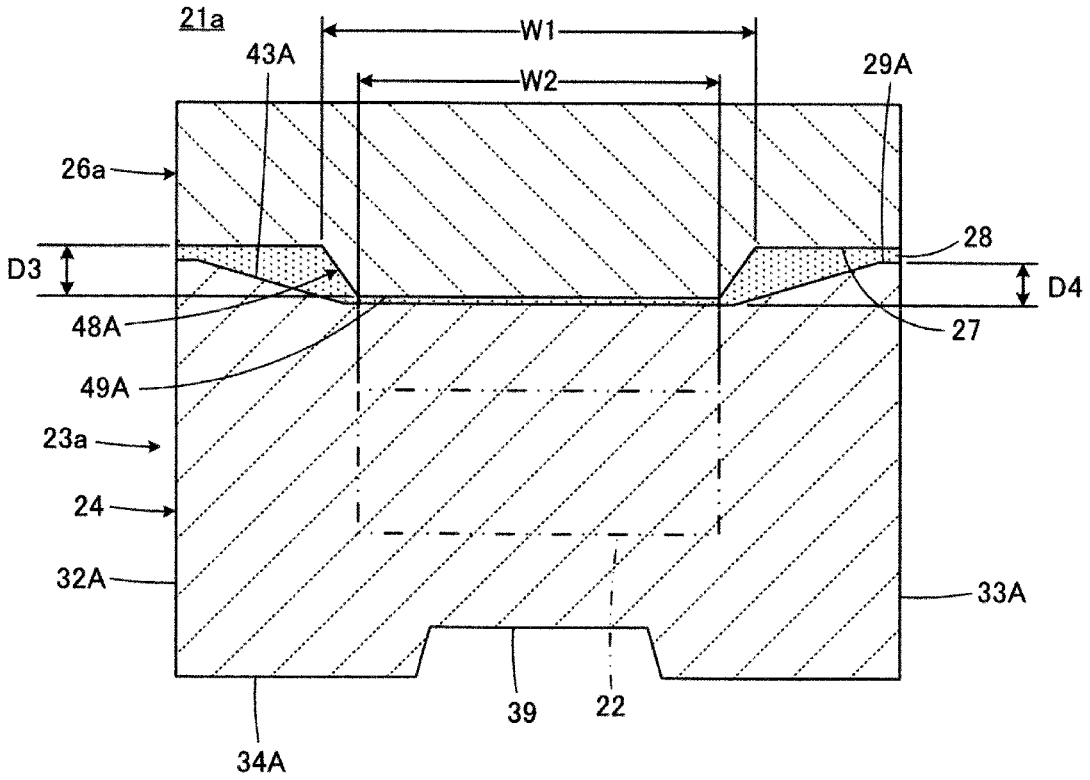
FIG. 5 is a sectional view of a combination of a winding core and a plate core that a coil component according to a second embodiment of the present disclosure includes and corresponds to FIG. 4.
Figure 6:
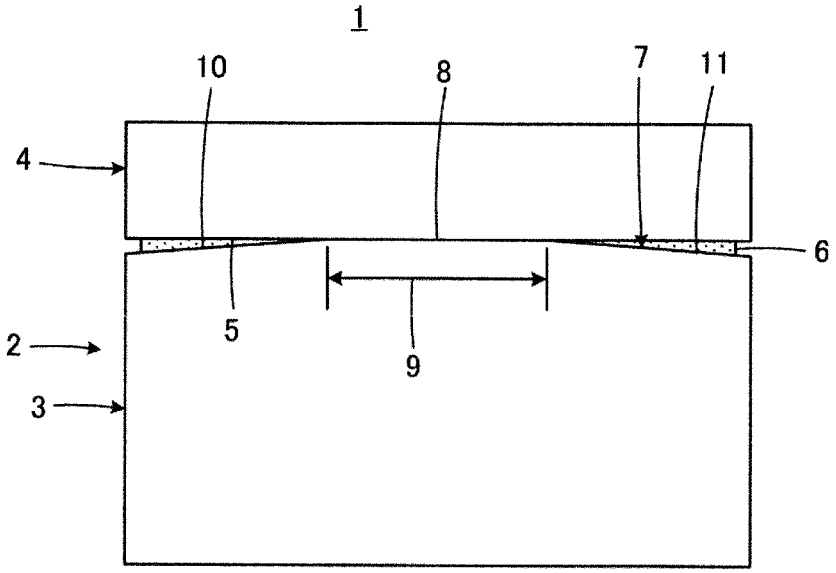
FIG. 6 is a side view of a coil component disclosed in Japanese Unexamined Patent Application Publication No. 2014-99587 and illustrates a first flange portion and a plate core of a winding core.

A top portion 45A of the protrusion 44A and a top portion 45B of the protrusion 44B are in direct contact with the main surface 27 of the plate core 26 or are connected thereto with the adhesive 28 interposed therebetween. FIG. 4 illustrates a state in which the top portion 45A of the protrusion 44A is connected to the main surface 27 of the plate core 26 with the adhesive 28 interposed therebetween. In FIG. 4 and FIG. 5 described later, the distance between the first flange portion 24 and the plate core 26 is exaggeratedly illustrated as compared with the actual distance. In the case where the top portion 45A of the protrusion 44A and the top portion 45B of the protrusion 44B are in direct contact with the main surface 27 of the plate core 26 or are connected thereto with the adhesive 28 interposed therebetween, a magnetic path that extends through the protrusion 44A and the protrusion 44B can be formed so as to be stable with certainty regardless of variation in state of surfaces of the winding core 23 and the plate core 26 that is caused by processes of manufacturing the winding core 23 and the plate core 26.

As illustrated in FIG. 2, the top portion 45A of the protrusion 44A is located so as to approach the position of the winding core portion 22 in the central portion of the upper surface 29A in the direction perpendicular to the axial direction of the winding core portion 22, and the top portion 45B of the protrusion 44B is located so as to approach the position of the winding core portion 22 in the central portion of the upper surface 29B in the direction perpendicular to the axial direction of the winding core portion 22. With this structure, the positions of contact between the protrusion 44A and the plate core 26 and between the protrusion 44B and the plate core 26 can be stable on the inside in the central portions of the first flange portion 24 and the second flange portion 25 of the winding core 23, regardless of the variation in state of surfaces of the winding core 23 and the plate core 26 that is caused by the processes of manufacturing the winding core 23 and the plate core 26. Accordingly, a magnetic path having a decreased length can be formed so as to be stable. For example, the inductance value is inhibited from varying and the inductance value can be kept high, in a radio frequency band that is higher than a band that is conventionally used or at a frequency where the magnetic permeability decreases of the winding core 23 and the plate core 26 that are each composed of ferrite.

As the protrusion 44A is illustrated in FIG. 4, the dimension W1 of the protrusion 44A and the protrusion 44B in a width direction is equal to or larger than the dimension W2 of the winding core portion 22 in the width direction, where the dimension in the width direction is measured in the direction perpendicular to the axial direction of the winding core portion 22 and in the direction in which the main surface 27 of the plate core 26 extends. Also, with this structure, the magnetic path is more stable, and the inductance value can be increased with a decreased variation.

In many cases, the contours of the recessed portion 43A and the recessed portion 43B are unclear. However, it is clear that the dimension of the recessed portion 43A and the recessed portion 43B in the width direction is smaller than the dimension of the first flange portion 24 and the second flange portion 25 in the width direction. It is preferable that the lower limit of the dimension of the recessed portion 43A and the recessed portion 43B in the width direction roughly depends on the dimension W2 of the winding core portion 22 in the width direction. In the case where the protrusion 44A and the protrusion 44B are formed, the dimension of the recessed portion 43A and the recessed portion 43B in the width direction is larger than the dimension W1 of the protrusion 44A and the protrusion 44B in the width direction. The dimensions are measured by using, for example, a laser microscope. Measurement points are five points that are freely selected, and the average thereof is calculated for the dimensions.

As the protrusion 44A is illustrated in FIG. 4, the heights of the protrusion 44A and the protrusion 44B are preferably the same as or slightly greater than the heights of the upper surface 29A and the upper surface 29B except for the recessed portion 43A and the recessed portion 43B. In other words, the heights of the protrusion 44A and the protrusion 44B are preferably determined such that the protrusion 44A and the protrusion 44B can be in contact with the main surface 27 of the plate core 26 regardless of whether the upper surface 29A and the upper surface 29B except for the recessed portion 43A and the recessed portion 43B are in contact with the main surface 27 of the plate core 26. Also, with this structure, the magnetic path is more stable, and the inductance value can be increased with a decreased variation.

The height of the protrusion 44A means the distance from the bottom surface 34A to the uppermost top portion of the protrusion 44A. The height of the protrusion 44B means the distance from the bottom surface 34B to the uppermost top portion of the protrusion 44B. The height of the protrusion 44A illustrated in FIG. 4 corresponds to a distance denoted by D1. The height of the upper surface 29A means the distance from the bottom surface 34A to the uppermost top portion of the upper surface 29A except for the protrusion 44A. The height of the upper surface 29B means the distance from the bottom surface 34B to the uppermost top portion to the upper surface 29B except for the protrusion 44B. The height of the upper surface 29A illustrated in FIG. 4 corresponds to a distance denoted by D2.

As seen in FIG. 2, among ridge portions of the first flange portion 24 and the second flange portion 25, ridge portions 46 and 47 that extend near the position of the winding core portion 22 along the upper surface 29A and the upper surface 29B do not have chamfer shapes, and sectional shapes of the ridge portions are more angular than sectional shapes of the other ridge portions. With this structure, a closed magnetic circuit can be formed along an inner path of the loop paths for the magnetic flux, and the inductance value at a radio frequency can be increased unlike the case where the ridge portions 46 and 47 have chamfer shapes.

However, as illustrated in FIG. 2, the ridge portions other than the ridge portions 46 and 47 of the first flange portion 24 and the second flange portion 25 have chamfer shapes, and the corners thereof are removed and rounded unlike the ridge portions 46 and 47. According to the present embodiment, the chamfer shapes of the ridge portions other than the ridge portions 46 and 47 are formed, for example, in a manner in which shapes corresponding to the chamfer shapes are formed in a mold that is to be used when the magnetic material powder is pressed and molded, and the required chamfer shapes are formed during molding. To avoid misunderstanding, it is remarked that the entire winding core 23 may be polished by barrel polishing, for example, to remove a burr after the chamfer shapes are formed on the ridge portions other than the ridge portions 46 and 47.

In the figures other than FIG. 1 and FIG. 2, an illustration of the chamfer shapes of the ridge portions other than the ridge portions 46 and 47 of the first flange portion 24 and the second flange portion 25 is omitted.

A coil component 21*a* according to a second embodiment of the present disclosure will now be described with reference to FIG. 5. FIG. 5 is a sectional view of a combination of a winding core 23*a* and a plate core 26*a* and corresponds to FIG. 4. In FIG. 5, components corresponding to the components illustrated in FIG. 4 are designated by like reference characters, and a duplicated description is omitted.

The second embodiment is characterized in that the plate core 26*a* has a protrusion 48A. This is more specifically described for the structure of the first flange portion 24 illustrated in FIG. 5. The protrusion 48A is formed on the main surface 27 of the plate core 26*a* in a region in which the recessed portion 43A on the upper surface 29A of the first flange portion 24 faces the main surface 27 of the plate core 26*a*.

The protrusion 48A enables effects similar to the effects of the protrusion 44A and the protrusion 44B to be achieved. More specifically, the protrusion 48A inside the recessed portion 43A enables the magnetic path to be stable. For this reason, the inductance value can be increased with a decreased variation.

Also, according to the second embodiment, preferred structures with aims similar to the aims according to the first embodiment are used.

A top portion 49A of the protrusion 48A is in direct contact with a portion of the upper surface 29A on which the recessed portion 43A is formed or is connected thereto with the adhesive 28 interposed therebetween. Consequently, the magnetic path that extends through the protrusion 48A can be formed so as to be stable with certainty.

The top portion 49A of the protrusion 48A is located in a central portion of the main surface 27 of the plate core 26*a* in the direction perpendicular to the axial direction of the winding core portion 22 so as to approach the position of the winding core portion 22, although this is not clearly illustrated in FIG. 5. With this structure, the position of contact between the protrusion 48A and the first flange portion 24 can be stable on the inside in the central portion of the first flange portion 24. Accordingly, a magnetic path having a decreased length can be formed so as to be stable, the inductance value is inhibited from varying in a radio frequency band that is higher than a band that is conventionally used or at a frequency at which the magnetic permeability of the winding core 23*a* and the plate core 26*a* that are each composed of, for example, ferrite decreases, and the inductance value can be kept high.

The dimension W1 of the protrusion 48A in the width direction is equal to or larger than the dimension W2 of the winding core portion 22 in the width direction, where the dimension in the width direction is measured in the direction perpendicular to the axial direction of the winding core portion 22 and in the direction in which the main surface 27 of the plate core 26*a* extends. Also, with this structure, the magnetic path is more stable, and the inductance value can be increased with a decreased variation.

The height of the protrusion 48A is preferably the same as or slightly greater than the depth of the recessed portion 43A. In other words, the height of the protrusion 48A is preferably determined such that the protrusion 48A can be in contact with the portion of the upper surface 29A on which the recessed portion 43A is formed regardless of whether the upper surface 29A except for the recessed portion 43A is in contact with the main surface 27 of the plate core 26*a*. Also, with this structure, the magnetic path is more stable, and the inductance value can be increased with a decreased variation.

The height of the protrusion 48A means the distance from the lowermost portion of the main surface 27 to the uppermost top portion of the protrusion 48A. The height of the protrusion 48A illustrated in FIG. 5 corresponds to a distance denoted by D3. The depth of the recessed portion 43A means the distance from the bottom of the recessed portion 43A to the uppermost top portion of the upper surface 29A except for the protrusion 48A. The depth of the recessed portion 43A illustrated in FIG. 5 corresponds to a distance denoted by D4.

The structure of the first flange portion 24 is described above. The structure of the second flange portion 25 that is not illustrated in FIG. 5 is substantially the same as the structure of the first flange portion 24. For convenience of the following description, a protrusion that is located near the second flange portion 25 and that is not illustrated is designated by the reference character "48B", and the top portion thereof is designated by the reference character "49B".

The present disclosure is described above with the embodiments illustrated. Various modifications can be made within the range of the present disclosure.

For example, although the shape of the first flange portion 24 and the shape of the second flange portion 25 are symmetrical according to the embodiments illustrated, the shapes may be asymmetrical. The structure of the first flange portion 24 and the structure of the second flange portion 25 may be asymmetrical. That is, the protrusions 44A and 44B may be formed only on the first flange portion 24 or the second flange portion 25, or the protrusions 48A and 48B may be formed only near the first flange portion 24 or the second flange portion 25. A combination of the recessed portions 43A and 43B and the protrusions 44A and 44B, or a combination of the recessed portions 43A and 43B and the protrusions 48A and 48B may be formed only on and near the first flange portion 24 or the second flange portion 25.

The protrusions 44A and 44B may have swells or recesses on the top portions 45A and 45B. The protrusions 48A and 48B may have swells or recesses on the top portions 49A and 49B.

The coil component may include at least one of the protrusions 44A and 44B that are formed inside the recessed portions 43A and 43B and at least one of the protrusions 48A and 48B that are formed on the plate core 26*a*. In this case, the first flange portion 24 and the second flange portion 25 may have different roles such that the protrusion 44A is formed inside the recessed portion 43A in the first flange portion 24 and the protrusion 48B that is not illustrated is formed on the plate core 26*a* near the second flange portion 25. Alternatively, the protrusion 44A may be formed inside the recessed portion 43A in the first flange portion 24, and the protrusion 44B may be formed inside the recessed portion 43B in the second flange portion 25, and the protrusion 48A or 48B may be formed on the plate core 26*a*. In the latter case, the top portion 45A of the protrusion 44A that is formed inside the recessed portion 43A may face the top portion 49A of the protrusion 48A that is formed on the plate core 26*a* along a line or may shift with respect to each other, and the top portion 45B of the protrusion 44B that is formed inside the recessed portion 43B may face the top portion 49B of the protrusion 48B that is formed on the plate core 26*a* along a line or may shift with respect to each other.

According to the above embodiments, the coil component 21 or 21*a* forms a common mode choke coil but may form a single coil, or may form a transformer or a balun. Accordingly, there may be a single wire or three or more wires, and the number of the terminal electrodes that are disposed on the flange portions can be changed accordingly.

The structures described according to the different embodiments in the specification may be partially replaced or combined to provide a coil component according to an embodiment of the present disclosure.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a winding core that includes a winding core portion, and a first flange portion and a second flange portion that are disposed on corresponding end portions of the winding core portion and that are opposite each other in an axial direction;

a plate core that has a main surface facing the winding core portion, the first flange portion, and the second flange portion, that extends between the first flange portion and the second flange portion, and that is secured to the winding core by using adhesive; and at least one wire that is wound around the winding core portion, wherein each of the first flange portion and the second flange portion has an upper surface that faces the main surface of the plate core, at least one recessed portion is formed on the upper surface of the first flange portion or the upper surface of the second flange portion, and the at least one recessed portion has a bottom that is at a central portion of the upper surface of the first flange portion or a central portion of the upper surface of the second flange portion in a direction perpendicular to the axial direction of the winding core portion, and the bottom approaches a position to a side of the first flange portion or a side of the second flange portion where the winding core portion is located in an axial direction of the winding core portion, at least one protrusion is formed in a region in which the at least one recessed portion on the upper surface of the first flange portion or on the upper surface of the second flange portion faces the main surface of the plate core, and the at least one protrusion includes a first protrusion that is surrounded by the at least one recessed portion on the upper surface of the first flange portion or on the upper surface of the second flange portion.

2. The coil component according to claim 1, wherein the at least one recessed portion includes at least one first recessed portion formed on the upper surface of the first flange portion and at least one second recessed portion formed on the upper surface of the second flange portion.

3. The coil component according to claim 1, wherein the at least one recessed portion is located so as to approach the position of the winding core portion in the central portion of the upper surface of the first flange portion or the central portion of the upper surface of the second flange portion in the direction perpendicular to the axial direction of the winding core portion.

4. The coil component according to claim 1, wherein the first protrusion has a top portion that is in direct contact with the main surface of the plate core or that is connected thereto with the adhesive interposed therebetween.

5. The coil component according to claim 4, wherein the top portion of the first protrusion is located so as to approach the position of the winding core portion in the central portion of the upper surface of the first flange portion or the central portion of the upper surface of the second flange portion in the direction perpendicular to the axial direction of the winding core portion.

6. The coil component according to claim 1, wherein a dimension of the first protrusion in a width direction is equal to or larger than a dimension of the winding core portion in the width direction, where the dimension in the width direction is measured in the direction perpendicular to the axial direction of the winding core portion and in a direction in which the main surface of the plate core extends.

7. The coil component according to claim 1, wherein a height of the first protrusion is equal to or greater than a height of the upper surface of the first flange portion or the upper surface of the second flange portion except for the at least one protrusion.

8. The coil component according to claim 1, wherein the at least one protrusion includes a second protrusion that is formed on the main surface of the plate core.

9. The coil component according to claim 8, wherein the second protrusion has a top portion that is in direct contact with a portion of the upper surface of the first flange portion or a portion of the upper surface of the second flange portion on which the at least one recessed portion is formed, or that is connected thereto with the adhesive interposed therebetween.

10. The coil component according to claim 9, wherein the top portion of the second protrusion is located so as to approach the position of the winding core portion in a central portion of the main surface of the plate core in the direction perpendicular to the axial direction of the winding core portion, in a region in which the at least one recessed portion faces the main surface of the plate core.

11. The coil component according to claim 8, wherein a dimension of the second protrusion in a width direction is equal to or larger than a dimension of the winding core portion in the width direction, where the dimension in the width direction is measured in the direction perpendicular to the axial direction of the winding core portion and in a direction in which the main surface of the plate core extends.

12. The coil component according to claim 8, wherein a height of the second protrusion is equal to or greater than a depth of the at least one recessed portion.

13. The coil component according to claim 1, wherein a ratio of a sectional area of the winding core portion, taken along a plane perpendicular to an axis of the winding core portion, to each sectional area of the first flange portion and the second flange portion, taken along a plane perpendicular to the axis of the winding core portion, is from 0.14 to 0.25.

14. The coil component according to claim 1, wherein a sectional shape of a ridge portion of the first flange portion that extends near the position of the winding core portion along the upper surface of the first flange portion is more angular than sectional shapes of other ridge portions of the first flange portion; and a sectional shape of a ridge portion of the second flange portion that extends near the position of the winding core portion along the upper surface of the second flange portion is more angular than sectional shapes of other ridge portions of the second flange portion.

15. The coil component according to claim 1, wherein the winding core and the plate core are each composed of a sintered body of magnetic material powder.

16. The coil component according to claim 2, wherein the at least one recessed portion is located so as to approach the position of the winding core portion in the central portion of the upper surface of the first flange portion or the central portion of the upper surface of the second flange portion in the direction perpendicular to the axial direction of the winding core portion.

17. The coil component according to claim 2, wherein at least one protrusion is formed in a region in which the at least one recessed portion on the upper surface of the first flange portion or on the upper surface of the second flange portion faces the main surface of the plate core.

18. The coil component according to claim 4, wherein a dimension of the first protrusion in a width direction is equal to or larger than a dimension of the winding core portion in the width direction, where the dimension in the width direction is measured in the direction perpendicular to the axial direction of the winding core portion and in a direction in which the main surface of the plate core extends.

19. The coil component according to claim 4, wherein the at least one protrusion has at least one swell or at least one recess on the top portion.

20. The coil component according to claim 1, wherein the first flange portion and the second flange portion have an inner surface that faces the winding core portion and that is in contact with one end portion of the winding core portion, the first protrusion constitutes part of the inner surface.

* * * * *